United States Patent [19]

Nakahara et al.

[11] 4,200,051

[45] Apr. 29, 1980

[54] COLLAPSIBLE TUBE AND METHOD OF MANUFACTURE

[75] Inventors: Yoshihiko Nakahara, Hino; Norihiro Tsujii, Atami; Kenichi Nakanishi, Ashigara; Katsuaki Terada, Fujimi; Yuji Sakai, Nakai; Toshitaka Sunahara, Seki; Shinobu Ito, Tokyo, all of Japan

[73] Assignees: Kyodo Insatsu Kabushiki Kaisha; Lion Hamigaki Kabushiki Kaisha, both of Tokyo, Japan

[21] Appl. No.: 900,969

[22] Filed: Apr. 28, 1978

[30] Foreign Application Priority Data

Apr. 28, 1977 [JP] Japan ..... 52-48377

[51] Int. Cl.[2] ..... B21D 51/36

[52] U.S. Cl. ..... 113/120 D; 113/120 H; 113/120 A

[58] Field of Search ..... 113/7 R, 120 D, 120 H, 113/120 A; 72/349

[56] References Cited

U.S. PATENT DOCUMENTS

| | | | |
|---|---|---|---|
| 1,403,460 | 1/1922 | Talty | 113/120 D |
| 2,112,085 | 3/1938 | Friden | 113/120 D |
| 2,412,813 | 12/1946 | Keller | 113/120 H |
| 3,194,428 | 7/1965 | Dereich | 113/120 A |
| 3,655,349 | 4/1972 | Shah et al. | 72/349 |
| 3,760,751 | 9/1973 | Dunn et al. | 113/120 A |
| 3,972,702 | 8/1976 | McCormick et al. | 113/120 H |

*Primary Examiner*—Michael J. Keenan

*Attorney, Agent, or Firm*—Blum, Kaplan, Friedman, Silberman & Beran

[57] ABSTRACT

A side seamless composite type collapsible tube having a tubular nipple section, a shoulder section and a tubular barrel section for receiving an extractable content is provided. The tube sections are formed of a continuous wall of metallic material having a wall thickness from about 20 to 70μ with at least a portion of the tubular barrel section coated with a synthetic resinous layer of from about 50 to 500μ thick. A method of forming the tube from a metallic blank material is also provided.

12 Claims, 14 Drawing Figures

COLLAPSIBLE TUBE AND METHOD OF MANUFACTURE

BACKGROUND OF THE INVENTION

This invention relates generally to a composite type collapsible tube and more particularly to an improved collapsible tube having no side seam and methods of manufacture.

Most known extruded metallic tubes are manufactured by impact extrusion, and have barrel section wall thickness ranging between 100 and 150μ. This value of wall thickness has been selected as being optimum from a viewpoint of the packing characteristics of the product tubes. Too large a wall thickness will deteriorate the characteristics of the tube for pressing out the content, and increases the cost of production; and too small a wall thickness often causes difficulties in the production process for avoiding pin-holes, wrinkles, dents and other inconveniences which may be derived from too small a wall thickness. Further, these known metallic tubes are undesirably corroded by the contents when the content exhibits acidity or alkalinity. In addition, due to the plasticity of the metallic material, the tube cannot have restoring or recovering characteristics, often resulting in breakage of the tube allowing the content to leak out of the tube.

To overcome these problems or shortcomings, various attempts have been made up to now. However, unfortunately, no successful attempt has been made which can completely overcome these problems inherent in the extruded metallic tube.

More specifically, it has been proposed to improve the nature of an inner resin coating or the inner coating method itself, so as to increase the chemical stability of the inner surface of the tube against an acidic or alkali content. At the same time, attempts have been made to fit shrink tubes or to apply shrinking paint, in order to improve the recovery characteristics of the tubes. However, these proposals and attempts are still insufficient and can not be put into practical use.

Conventionally, as a countermeasure for preventing breakage of the tube due to dents or bends, the wall thickness has been increased to some extent, and the metallic material is made to undergo sufficient annealing. Thus, it is contrary to conventional technical ideas to reduce the thickness of the metallic layer, especially at the barrel section of the tube. Rather, thinning of the wall has been considered as a cause for deterioration of the tube characteristics. This state of the technology is established by the fact that all of the considerable number of prior art proposals up to now fail to teach or suggest the thinning of the metallic tube wall, especially at the barrel portion, as far as the present inventors know. At the same time, it is to be pointed out that no prior art has been found through a search conducted by the present inventors, concerning a method for producing metallic tubes having a barrel section thickness as small as 70μ or less. In fact, no thin-walled metallic tube has been developed up to now. A study has not been made as to the thinning of the metallic tube wall, because it is commonly accepted that a thin wall inevitably leads to deterioration of mechanical strength.

Plastic tubes and laminate tubes have become popular recently, because they are free from some of the above described problems inherent in the metallic tubes. However, the plastic tube often results in a change of weight of the contents or degradation of the contents, due to its poor barrier properties. At the same time, the recovery force of the plastic tubular structure is too strong so that air is sucked in and stays in the tube, resulting in a further degradation of the contents or difficulty in pressing out the contents.

Turning to the laminate tubes, the most commonly adopted production process includes the step of seaming a laminate film, such as a metal foil into a tubular form, attaching a neck portion to the tubular body by means of injection molding to form a press-out tube. This process inevitably causes a side seam in the tubular barrel section, often resulting in leakage of the content due to peeling off at the side seam. In addition, the gas-barrier property of this tube is not sufficiently reliable, especially at the neck and shoulder portions of the tube. The side seam inconveniently deteriorates the appearance of the product tube. Further, for obtaining a good heat-seam at the barrel portion and good workability or shaping characteristic of the shoulder portion, the resinous material to be used is limited only to the thermoplastic resins. At the same time, since the neck portion constitutes only resin, the wall thickness at the neck portion has to be considerably large in order to provide a sufficient barrier property. Furthermore, the nature of the contents accommodatable by this type of tube is limited or restricted from a viewpoint of chemical stability. The use of the tube for holding a material which requires heat sterilization is prohibited, because the side seam of the barrel section may be broken as it is subjected to a high temperature in the course of the heat sterilization.

With respect to the recovery characteristic of this type of tube, it is extremely difficult to obtain the desired recovery characteristics through an adjustment or preparation of layers. A reduced recovery force is obtainable by thickening the layer of metallic material which tends to exhibit a plastic deformation, such as aluminum foil. However, in conventional laminate tubes, aluminum foil is used not for the purpose of adjusting the recovery characteristics, but rather for the purpose of improving the barrier property of the product tube. In addition, thickening the plastically deformable layer does not directly lead to the thinning of another layer or layers. In other words, the other layers may not be thinner, even when the thickness of the plastically deformable layer is increased. Otherwise the desired chemical stability against the contents and the protecting characteristics of the tube against external conditions will not be obtained. This means that the total thickness of the tube is inconveniently increased. Consequently, the bonding strength at the side seam and/or end seal portion is lowered, allowing the contents to escape from the tube.

Accordingly, it is desirable to provide a composite collapsible tube which is entirely free from the above noted shortcomings or drawbacks of conventional metallic tubes, laminate tubes and plastic tubes, while preserving and making use of the advantages of these tubes.

SUMMARY OF THE INVENTION

Generally speaking, in accordance with the invention, an improved side seamless mono-block type composite collapsible tube is provided. The improved tube comprises a tubular nipple section for removing contents therethrough; a shoulder section connected to the tubular nipple; and a tubular barrel section connected to the shoulder. The tube sections form a continuous metallic wall having a hollow interior space for receiving the contents and have a wall thickness ranging from about 20 to 70μ. The metallic wall is seamless and coated on at least one surface of at least the portion thereof constituting the tubular barrel section with a layer of a synthetic resin in thickness from about 50 to 500μ.

According to another aspect of the invention, there are provided methods of manufacturing a side seamless mono-block type composite collapsible tube from a metallic material. The method includes the steps of forming the metallic material into a continuous wall tube blank having a tubular nipple section, a tubular shoulder section and a tubular barrel section; ironing the tubular barrel section of the tube blank into a tubular body having a wall thickness from about 20 to 70μ; and applying a layer of synthetic resin from about 50 to 500μ in thickness onto at least one surface of the tubular body wall.

Accordingly, it is an object of the invention to provide an improved side seamless collapsible tube.

Another object of the invention is to provide an improved method of forming a side seamless collapsible tube.

A further object of the invention is to provide an improved side seamless collapsible tube of reduced wall thickness.

Still another object of the invention is to provide an improved composite side seamless collapsible tube of a thin walled metallic material and a synthetic resinous layer.

Another object of the invention is to provide an improved method of forming a composite collapsible tube, in which a synthetic resinous layer is provided on the wall of an extremely thin walled metallic tube.

Still another object of the invention is to provide a method of manufacturing a mono-block type side seamless collapsible tube easily and for reduced cost.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1A:
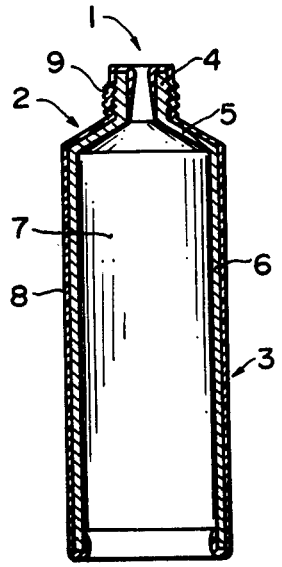
FIG. 1*a* is an elevational cross-sectional view illustrating a composite type collapsible tube constructed and arranged in accordance with the invention.
Figure 1B:
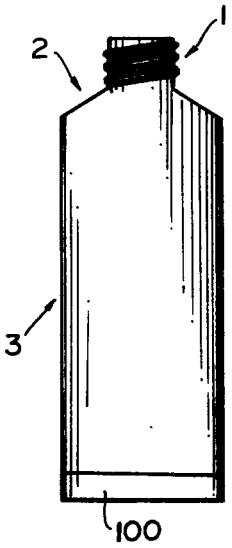
FIG. 1*b* is an elevational view illustrating the composite type collapsible tube of FIG. 1*a* with one end portion of the barrel section sealed off.

Referring specifically to FIG. 1*a*, a side seamless mono-block type composite tube constructed and arranged in accordance with the invention is shown. The composite collapsible tube includes a tubular nipple section 1 through which the contents is removed, a frusto-conical shoulder section 2 connected to tubular nipple section 1, and a tubular barrel section 3 connected to shoulder section 2. Nipple section 1, shoulder section 2 and barrel section 3 form a continuous wall including a nipple wall portion 4, a should wall portion 5 and a barrel wall portion 6 formed from a metallic material, such as aluminum. The continuous wall forms a hollow interior space 7 for receiving the tube contents. The barrel wall portion 6 forming barrel section 3 has a thickness suitably selected from a range of between 20 and 70μ, preferably between 20 and 50μ, and has no side seam in an axial direction thereof. The continuous wall is coated on its outer surface with a layer 8 of a synthetic resin of a thickness within the range of between 50 and 500μ. In FIG. 1*a* barrel section 3 is shown opened at its one end, however, this end may be sealed as an end seal 100 by a known technique after filling the tube with the contents as shown in FIG. 1*b*. In the illustrated embodiment, synthetic resinous layer 8 is provided specifically on the outer surface of metallic wall on nipple wall portion 4, shoulder wall portion 5 and barrel wall portion 6.

This arrangement of the synthetic resinous layer 8 is not exclusive. For instance, as will be described later, synthetic resinous layer 8 may be provided only on the inner surface of the continuous wall or on both the inner and outer surfaces of the same, as occasion demands. In any case, the total thickness of the layer or layers of synthetic resin should be maintained within the range of between about 50 and 500μ.

In accordance with the invention, it is not essential to provide synthetic resinous layer 8 on nipple section 1 and shoulder section 2, and it can be eliminated if desired. Thus, in accordance with the invention, synthetic resinous layer 8 is provided on at least barrel wall portion 6 of barrel section 3. A screw portion 9 is formed if desired on nipple section 1 for engaging and retaining a cap (not shown) having a mating screw.

A process for forming the composite collapsible tube as set forth above will now be described. As a first step of the process, a metallic material is formed into a tube blank 14 having tubular nipple section 1, shoulder section 2 and tubular barrel section 3 forming the continuous tube wall. Aluminum or its well known alloy is most suitably used as the metallic material, although other metallic materials having similar ductile properties which would not hinder the shaping processing, such as tin, lead and tin-lead lamination blank may be used. There are two routes for forming the tube blank.

Figure 2:
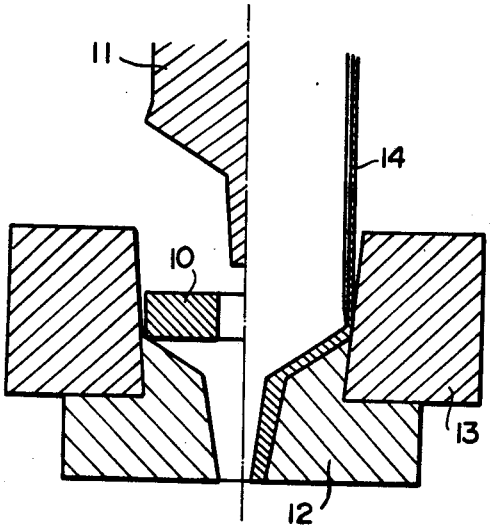
FIG. 2 is a diagrammatical-sectional view illustrating the process of forming a tube blank, with the left side showing the state before forming and the right side after forming.

The first route relies on impact extruding as shown in FIG. 2, which is commonly used in the formation of metallic tubes. This route for forming the tube blank will be referred to as "method I", hereinafter. Method I is carried out by means of a die center 12, a die ring 13 and a punch 11. As this method is known in the art, a detailed description will not be set forth, except to note that in FIG. 2 a blank material 10 and a formed tube blank 14 are shown.

The second route for forming tube blank 14 consists of a drawing process. The steps of burring, necking, punching, journaling and so forth may be combined with the drawing process as shown in FIGS. 3*a* to 3*e* and FIGS. 4*a* to 4*c*, for forming the tube blank 14. The second route for forming the tube blank will be referred to as "method $D_1$", hereinafter.

Figure 3A:
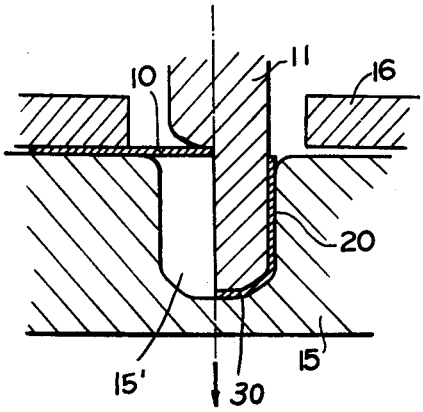
FIGS. 3*a* to 3*e* are diagrammatical-sectional views illustrating another process of forming the tube blank, the left side of each figure showing the state before forming and the right side after forming.
Figure 3B:
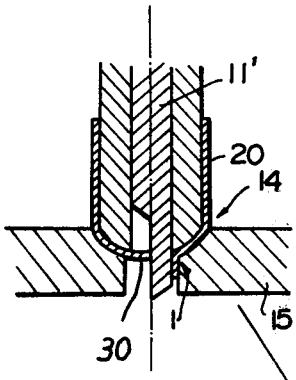

The drawing process is carried out in the manner shown in FIG. 3*a*. Namely, blank material 10 is held between a die 15 formed with a cavity 15' for shaping material 10 and a blank holder 16. Material 10 is shaped into a bottomed cylindrical body 20 by means of a punch 11 pushing material 10 into cavity 15' in die 15. FIG. 3*b* shows the manner in which tubular nipple section 1 is formed on tubular body 20 which has been formed by the drawing as shown in FIG. 3*a*. Tubular nipple section 1 is formed by means of burring with an inner punch 11' forming an opening in a portion of bottom 30 for forming tube blank 14.

Figure 3C:
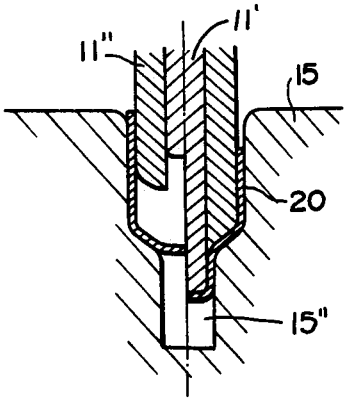
Figure 3D:
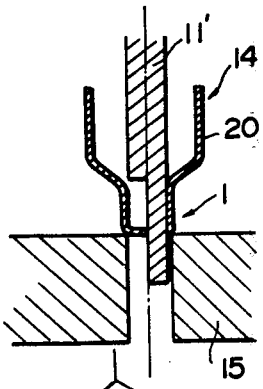
Figure 3E:
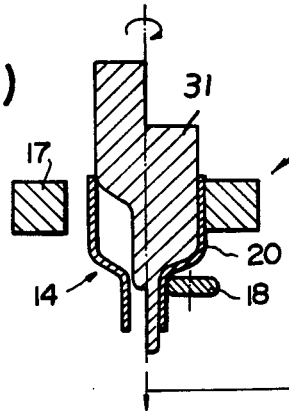

FIG. 3*c* illustrates the step of redrawing bottom 30 of cylindrical body 20. Nipple section 1 is formed by drawing inner punch 11' into a second smaller diameter cavity 15'' in die 15. An outer punch 11'' is provided for compressing cylindrical body 20 against the die cavity for maintaining the shape of cylindrical body 20. FIG. 3*d* illustrates forming tubular nipple section 1 of tube blank 14 by punching bottom 30 of cylindrical body 20 formed by the step of FIG. 3*c* with inner punch 11'. Finally, FIG. 3*e* shows a necking step wherein nipple section 1 of tube blank 14 is formed by necking cylindrical body 20 with a chuck 17 and a spinning roll 18 against a necking form 31.

Figure 4A:
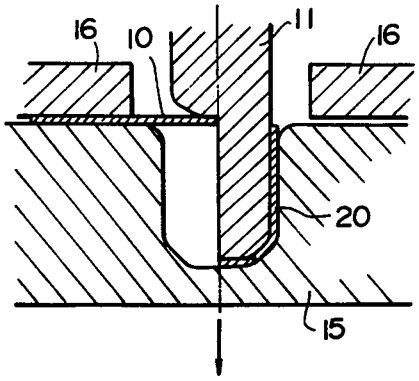
FIGS. 4*a* to 4*c* are diagrammatical-sectional views illustrating a further process of forming the tube blank, the left side of each figure showing the state before forming and the right side after forming.
Figure 4B:
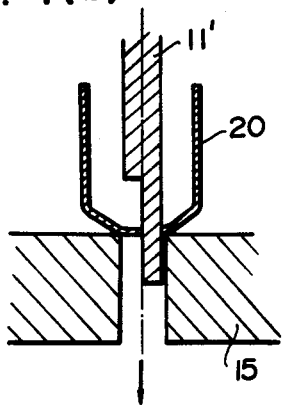
Figure 4C:
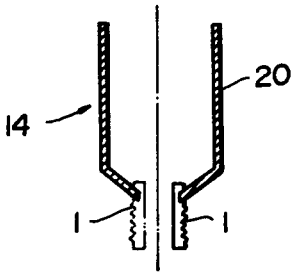

Similarly, FIG. 4*a* shows a drawing step similar to that of FIG. 3*a*. FIG. 4*b* illustrates forming an opening in bottom 30 by punching bottom 30 of bottomed cylindrical body 20 formed by the step of FIG. 4*a* with inner punch 11'. FIG. 4*c* shows the manner in which tube blank 14 is formed by journaling threaded nipple section 1 into cylindrical body 20 shaped in the step of FIG. 4*b*.

In FIGS. 3*a* to 3*e* and FIGS. 4*a* to 4*c*, arrows show examples of the sequence of steps of the process. It will be seen that a number of combinations of steps are possible. A detailed description of the respective processing methods has been omitted, since these burring, necking, punching and journaling methods are known in the art.

Figure 5:
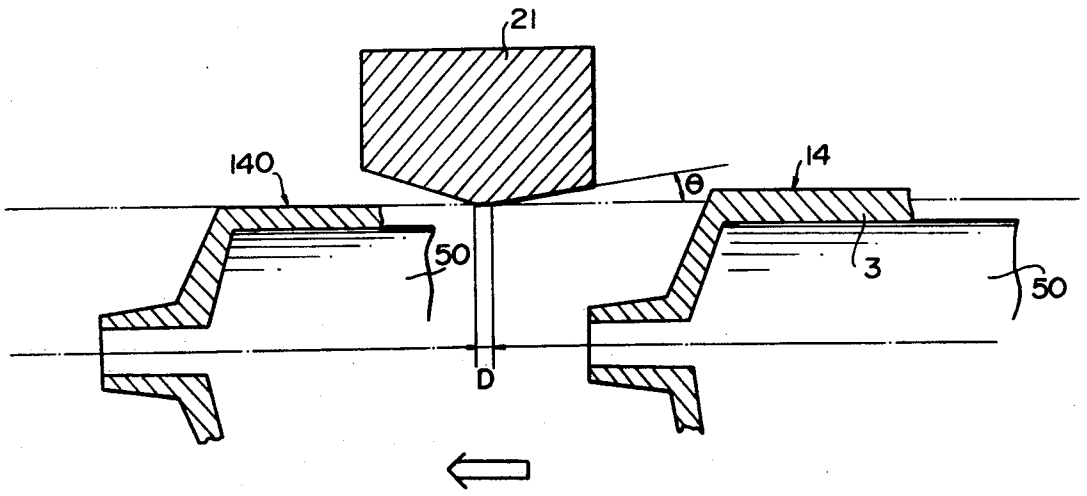
FIG. 5 is a diagrammatical-sectional view illustrating the process of forming the barrel section in the tubular body.
Figure 6:
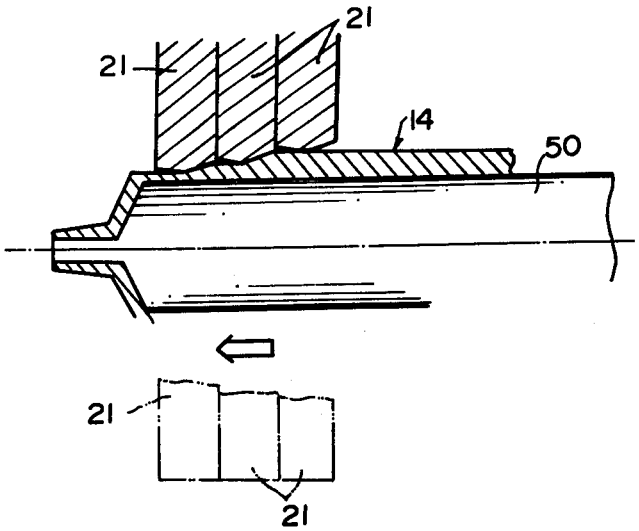
FIG. 6 is a diagrammatical-sectional view illustrating another process of forming the barrel section in the tubular body.

In the second step of the process barrel wall portion 6 of tube blank 14 formed by the first step is reduced in thickness to between about 20 and 70μ. As shown in FIGS. 5 and 6, thickness reduction includes drawing or ironing tube blank 14 held by a jig 50 inserted into interior space 7 of tube blank 14 through a lubricated die ring 21. This drawing reduces barrel wall portion 6 in thickness to form a tubular body 140 having barrel wall portion 6 of from about 20 to 70μ thick, and preferably from about 20 to 50μ. A pliurality of die rings 21 of different drawing characteristics may be used, depending on the size of tube blank 14 to be drawn. Alternatively, tube blank 14 may be drawn through a series of die rings 21 of successively decreasing diameters as shown in FIG. 6 may be used.

By way of example, drawing conditions may include a wall thickness reduction ratio of 5 to 50%, a slip-in angle of 0.5° to 7.0°, a horizontal drawing distance of 0.01 to 1.00 mm and a hardness of die ring 21 of HRC 50 to 100. The term "wall thickness reduction ratio" is used to mean the ratio of the reduction T-t of the barrel wall after drawing to barrel wall thickness T of the tube blank before the ironing, i.e. $T-t/T \times 100$. The drawing conditions, more preferably includes the wall thickness reduction ratio of 10 to 30%, slip-in angle $\theta$ of from 1° to 4°, ironing the horizontal distance D of from 0.01 to 0.75 mm and a hardness of die ring of HRC 60 to 80. In a most preferred embodiment, wall thickness reduction ratio of about 20%, slip-in angle $\theta$ of 2°, ironing horizontal distance D of from 0.01 to 0.50 mm and the hardness of die ring 21 of about HRC 65.

It is not essential that all of these drawing conditions be satisfied at the same time. The yield will be increased when at least one of these conditions is fulfilled. However, from a viewpoint of simplification of the process and lowering of the manufacturing cost and product quality of the product, it is desirable that all of these requisites are fully met. In the drawings, symbols $\theta$ and D denote, respectively, the slip-in angle and the ironing horizontal distance, while arrow marks show the direction in which the tube blank is moved during the drawing step. The unnecessary part of barrel section 3 and nipple section 1 of formed tubular body 140 may each be cut off in predetermined lengths by any well know method. Of course, the unnecessary part of nipple section 1 may be cut off to yield the predetermined length of nipple section 1 before the above described drawing step.

Tubular body 140 having barrel wall 3 thickness of from 20 to 70μ is thus formed by the first and second steps. These are two combinations of steps for forming tubular body 140; namely, one is $D_1 \rightarrow$drawing relying upon drawing, while the other is I→drawing making use of the impact extrusion process.

These methods have respective characteristic features as follows. Referring first to $D_1 \rightarrow$drawing method, since a drawing process is carried out in the initial forming step, no substantial pressing power is required. Therefore, this method can be carried out with a relatively small machine. This method is suitable for the manufacture of containers of large diameter and when the metallic material is an alloy. Further, since the wall thickness at the shoulder section can be made small, material is saved and better press-out characteristics can be expected in the case of collapsible press-out tubes.

On the other hand, the I→drawing method is more suitable for a process using pure aluminum as the metallic material, yielding collapsible press-out tubes having a larger shoulder height from the bottom as compared with the tubes manufactured by the impacting process. Since the tubular body can have a sufficiently large shoulder height, the number of drawing and annealing steps and the number of die rings are conveniently reduced in the subsequent drawing step. Consequently, undesirable work-hardening is less likely to occur. Further, the shaping of the tubular nipple section can be completed in only one step, and the shape of the tubular nipple section can be made easily and conveniently.

Hereinafter, an explanation will be made as to the final step of forming the tube having a synthetic resinous layer of 50 to 500μ on the tubular body 140. In accordance with the invention, a coating step is used as the method of forming the synthetic resinous layer. This coating step includes formation of a synthetic resinous layer of a thickness larger than the predetermined thickness of the tubular body which is from 20 to 70μ; uniform thickness of the coating layer; smoothness of the surface of the coating layer; good conformity of the coating layer to the shape of the tubular body; and easy operation of the coating machine. For example, known methods such as repeated painting of tubular body 140 with a volatile paint; fusion welding by heating a plastic film onto tubular body 140; application of a lamination process in which the plastic extruded from a T die is press applied to a rotating tubular body 140; fluidization dip coating on tubular body 140; electrode position-sit-coating tubular body 140; powder coating on the tubular body 104; and so forth can be used.

In view of the shape of tubular body 140, the powder coating process is more preferred among these coating methods. In a more strict sense, the electrostatic powder coating process is most suitably used as the process for forming synthetic resinous layer 8 in accordance with the invention.

The coating of tubular body 140 with synthetic resinous layer 8 may be effected only at the outer side of tubular body 140 or only at the inner side of the same, or even at both sides of the same, depending on the uses of the product.

Coating at the outer side of tubular body 140 is effective for preventing tarnish of the screw portion of tubular nipple section 1 and for improving the mechanical strength at the boundary between shoulder section 2 and tubular barrel section 3. Additionally, it improves the appearance of the product. On the other hand, coating at the inner side of tubular body 140 is effective for preventing deterioration of the contents by preventing formation of pin holes and so forth. All of these advantages may be simultaneously obtained when the coating is effected on both surfaces of tubular body 140. In any case, for obtaining good recovery characteristics and flexibility of the composite tube during use, the total thickness of synthetic resin is selected to be within the range of between about 50 and 500μ.

Figure 7:
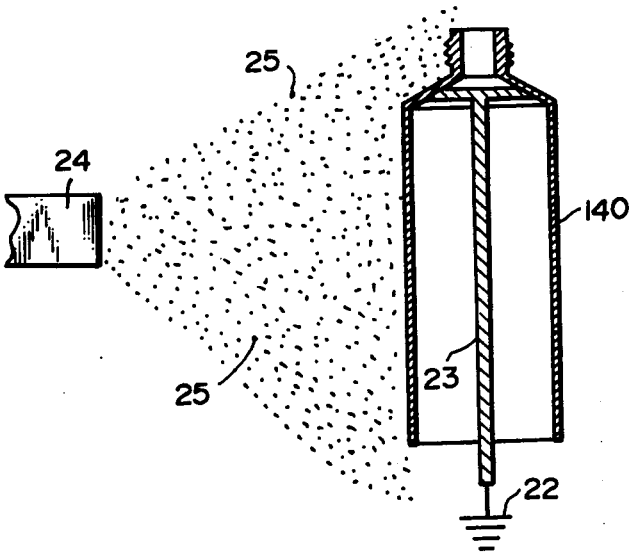
FIG. 7 is a diagrammatical-sectional view illustrating the process of applying a plastic layer onto the tubular body.

By way of an example, a process for applying synthetic resinous layer 8 on tubular body 140 by means of the electrostatic powder coating will be described. Referring specifically to FIG. 7, tubular body 140 is supported by a jig 23 ground electrically at 22. A resin powder 25 electrostatically charged is jetted onto tubular body 140 by an electrostatic coating gun 24, so that resin powder 25 attaches to the surface of tubular body 140 in uniform thickness. Then tubular body 140 is heated causing fusion welding of resin powders 25 into synthetic resin layer 8 of FIG. 1*a*. A composite collapsible tube constructed and arranged in accordance with the invention as shown in FIG. 1*a* can be obtained by subsequently cooling coated tubular body 140.

The synthetic resin material which may be used as powder 25 has to have good bonding characteristics to the metallic object, flexibility, air permeability, weather resistant property and be non-reactive with respect to the contents. Thus, thermoplastic resins, such as vinyl chloride, saturated polyesters, polyamides and polyolefinic resins, such as polyethylene and polypropylene, pre-polymers of thermosetting resins such as epoxy resins and unsaturated polyesters may be used.

Any of the above-mentioned resins can be used satisfactorily as the synthetic resinous material in accordance with the method of the invention. However, the use of thermoplastic resins is preferred when the open end of tubular barrel section 3 has to be sealed after loading of the content. More specifically, in a preferred embodiment of the invention, polyethylene resin is used because it has sufficient flexibility, is non-reactive with respect to the contents and because it is suitable from a viewpoint of food contamination.

In order to obtain good formation of synthetic resinous layer 8 by electrostatic powder coating, it is essential to select various conditions, such as electrostatic potential, discharge rate, discharge time, discharge distance, discharge angle, grain size distribution of the resin powders, heating time after the deposition of the powders heating temperature and so forth. These conditions vary depending on various requirements or conditions, such as desired thickness of the layer or layers, the composition of the resin, location of the coating layer to be formed, and so on.

For example, in order to obtain a resinous layer of 100μ thick on the outer surface of tubular body 140, the preferred conditions are as follows: electrostatic potential of about 90 KV, a discharge rate of about 120 g/min to 150 g/min, a discharge time of about 5 to 7 seconds, a discharge distance of about 20 to 30 cm, a horizontal discharging angle, a grain size distribution of about 30 to 100μ, a heating time of about 5 minutes, a heating temperature of about 180° C. and a single or multiple coating step.

Alternatively, the coating conditions may be as follows: an electrostatic potential of about 90 KV, a discharge rate of about 50 g/min., a discharge time of about 5 to 7 seconds, a discharge distance of about 20 cm, a horizontal discharging angle, a grain size distribution of about 30 to 100μ, a heating time of about 10 min, a heating temperature of about 200° C. and a triple coating before heating.

Finally, the relationship between the thickness of the metallic wall of tubular barrel section 3 and the thickness of the corresponding resinous layer 8 of the composite tube in accordance with the invention is as follows. This relationship depends on the kind of the resinous material used, the barrel diameter of tubular body 140, the kind of metallic material used and so forth. These thicknesses are selected from the aforementioned ranges, depending on the uses and desired recovery and press-out characteristics, mechanical strength and other requisites. Preferred examples of the layer thicknesses are shown in the following Table I.

TABLE I

| Metallic Material | Kind of Resin | Barrel dia. of tubular body (mm Φ) | Thickness of metallic layer at barrel section (μ) | Thickness of resin layer at barrel section (μ) | Position of resin layer coated |
|---|---|---|---|---|---|
| Al | Polyethylene | 35 | 20 | 350 | inner and outer |
| Al | Polyethylene | 35 | 40 | 300 | outer |
| Al | Polyethylene | 35 | 70 | 240 | inner |

TABLE I-continued

| Metallic Material | Kind of Resin | Barrel dia. of tubular body (mm Φ) | Thickness of metallic layer at barrel section (μ) | Thickness of resin layer at barrel section (μ) | Position of resin layer coated |
|---|---|---|---|---|---|
| Al | Epoxy | 35 | 60 | 110 | outer |
| Al | Polyester | 35 | 60 | 140 | outer |
| Al | Polyethylene | 25 | 30 | 320 | inner and outer |
| Sn | Polyester | 20 | 20 | 200 | inner and outer |
| Pb | Epoxy | 50 | 70 | 150 | inner |
| Al alloy (Al: more than 99%) | Polyethylene | 35 | 50 | 310 | outer |
| Sn - Pb laminated blank | Epoxy | 30 | 40 | 120 | outer |
| Al | Polyethylene | 90 | 70 | 500 | inner and outer |
| Al | Polyethylene | 35 | 50 | 180 | outer |

As has been described according to the invention, the kind of resin to be used, the thickness of the resinous layer, the thickness of metallic layer at the tubular barrel section and the location of the resinous coating can be selected optimumly quite easily. By suitably selecting and adjusting these factors, the composite tube having desired recovery and press-out characteristics and mechanical strength can be obtained without substantial limitation. The resultant composite tube does not suck in air or allow air to remain therein and has desirable anti-corrosion properties. In addition, undesirable tarnish at the tubular nipple section is effectively avoided by disposing the resinous coating on the tubular nipple section, in addition to the coating on the tubular barrel section. Another characteristic feature of the composite tube in accordance with the invention is that the product tube is a mono-block type side seamless tube. The side seamless nature provides various advantages as follows:

(1) no peeling off at seam portion and no leakage of content;
(2) good gas-barrier property;
(3) no dropping off of tubular shoulder section;
(4) attractive appearance; and
(5) good adaptability to printing.

Several examples will be described hereinafter, without intending to be limiting.

EXAMPLE 1

A pure aluminum slag (blank material) of 21.95 mm dia., 5.6 mm thick and having a central bore of 8.5 mm dia. was prepared. The blank material was in part extruded into a tube blank having a barrel wall thickness of 110μ, outer diameter of 22.2 mm and a shoulder height of 54 mm as measured from the bottom. This tube blank was then subjected to a triple drawing carried out by means of die rings to a tubular body having a barrel wall thickness of 67μ, height of shoulder of 82.5 mm as measured from bottom and a diameter of 22.10 mm. Condition of Ironing Dies:

| die ring No. | inner dia. of ring (mm) | slip-in angle | hardness (HRC) | wall-thickness reduction ratio (%) | ironing horizontal distance (mm) |
|---|---|---|---|---|---|
| 1 | 22.15 | 2° | 64 | 24 | 0.75 |
| 2 | 22.13 | 2° | 64 | 14 | 0.75 |
| 3 | 22.10 | 2° | 64 | 7 | 0.75 |

-continued

| processing step | | barrel wall thickness (mm) | height of shoulder from bottom (mm) |
|---|---|---|---|
| Impact extruding | | 0.11 | 54 |
| Ironing | 1st step | 0.084 | 64.53 |
| | 2nd step | 0.072 | 75.82 |
| | 3rd step | 0.067 | 82.5 |

The tubular body thus obtained, having a barrel wall thickness of 67μ, was sufficiently rinsed and defatted, and then annealed for 5 to 7 minutes at 500° C. until a sufficient softness is obtained. Meanwhile, a polyethylene resin, whose bonding characteristics have been improved by an addition of carboxyl group was pulverized into a powder of particles ranging in size from 30 to 100μ in diameter.

The powder was electrostatically charged up to a potential of 90 KV, and was jetted onto the surface of the tubular body which was grounded for 7 seconds at a rate of 150 g/min. Consequently, the tubular body was coated uniformly with the polyethylene powder. The tubular body and powder was heated for 10 minutes at 200° C. and the powder melted and became welded to the surface of the tubular body in a layer of about 150μ. If desired, the outer surface of the tube may be painted.

The resultant composite tube has a ratio of thickness of the metallic layer to that of resinous layer of about 1:2, at the tubular barrel section, so that the resiliency possessed by the resinous layer is somewhat larger than that of the metallic layer. Consequently, small bends and dents, which inevitably form in conventional metallic press-out tubes are avoided. When the tube is pressed strongly, the plastic deformation of the metallic layer becomes dominant, so as to overcome the resilient recovery force of the tube wall. Therefore, sucking air into the tube is avoided and prevents the contents from contacting the air which would otherwise contact and degrade the contents.

EXAMPLE 2

A tubular body having a barrel wall thickness of 67μ, shoulder height of 82.5 mm and diameter of 22.10 mm, formed in accordance with the triple drawing steps of Example 1 was then subjected to a further drawing step. The resultant tubular body had a barrel wall thickness of 50μ, shoulder height of 110.5 mm and diameter of 22.10 mm. The die ring conditions of the fourth drawing step was as follows:

| die ring No. | inner dia. of ring | slip-in angle | hardness (HRC) | wall-thickness reduction ratio | ironing horizontal distance |
|---|---|---|---|---|---|
| 4 | 22.07 mm | 2° | 65 | 25% | 0.50 mm |

The resultant tubular body was rinsed and defatted in the same manner as Example 1. Polyethylene powder was charged to a potential of 60 KV and jetted onto the tubular body for 5 seconds at a rate of 150 g/min. The powder was melted and welded to the tubular body by heating for 5 minutes at 180° C., to yield a composite tube with a resinous layer 100μ thick.

The resultant composite tube had a ratio of barrel metallic layer thickness to the barrel resinous layer thickness of about 1:2. The ratio of thickness of layers was equal to that of the Example 1, but the total thickness of the tube at its barrel section was 150μ. Since the total wall thickness was reduced by about 70μ in comparison with Example 1, the press-out characteristics of the tube was improved further. In addition, the recovery force of the tube wall was found somewhat larger than obtained in Example 1. Consequently, dents, bends and wrinkles during use were further diminished, thereby insuring a tube of improved appearance.

EXAMPLE 3

A pure aluminum slag (blank material) of 3.3 mm thick, 34.8 mm dia. and having a central bore of 11 mm was processed by impact extrusion into a tube blank having a barrel wall thickness of 80μ, shoulder height of 100 mm as measured from the tube bottom and a diameter of 35 mm. The tube blank was then triple drawn into a tubular body having a barrel wall thickness of 44μ, shoulder height of 195 mm and a diameter of 34.9 mm. Condition of Ironing Dies:

| die ring No. | inner dia. of ring (mm) | slip-in angle | hardness (HRC) | wall-thickness reduction ratio (%) | ironing horizontal distance (mm) |
|---|---|---|---|---|---|
| 1 | 34.98 | 2° | 65 | 19 | 0.50 |
| 2 | 34.95 | 2° | 65 | 20 | 0.50 |
| 3 | 34.94 | 2° | 65 | 15 | 0.50 |

| processing step | | barrel wall thickness (mm) | height of shoulder from bottom (mm) |
|---|---|---|---|
| Impact extruding | | 0.080 | 100 |
| Ironing | 1st step | 0.065 | 125 |
| | 2nd step | 0.052 | 156 |
| | 3rd step | 0.0442 | 195 |

The resultant tubular body having a barrel wall thickness of 44μ, was rinsed and defatted and then annealed for 7 minutes at about 500° C. The tubular body was grounded and supported for rotation and electrostatically powder coated on both inner and outer surfaces with polyethylene powder of grain sizes ranging from 30 to 150μ. The inner resinous layer and outer resinous layer were 50μ and 100μ thick, respectively. Condition of Electrostatic Powder Coating:

| coating machine name | posture | distance | volt applied | discharge rate g/min | discharge pressure Kg/cm² | discharge time sec | baking condition | coating surface |
|---|---|---|---|---|---|---|---|---|
| auto-REP-Z (*) | horizontal fixed | 210m | 90KV | 50 | 1.4 | 9 | 200° C. 10 min | outside |
| auto REP rotary (*) | vertical downward fixed | / | 90 | 67 | 1.4 | 6 | 180° C. 5 min. | inside |

The composite tube made in accordance with Example 3 had a total barrel wall thickness of about 190μ and a ratio of thickness of metallic layer to the resinous layers of 1:3.2. The tube featured a laminated structure in which the metallic layer was sandwiched between the two resinous layers for assuring better performance of the tube container.

Needless to say, the composite tube of the Example 3 exhibited no dents, foldings nor wrinkles which are inherent in conventional metallic press-out tube container. In addition, good press-out characteristics was observed. Further, no leaking out of the contents due to breakage of the tubular barrel section was observed which is the major drawback of laminated tubes. In addition, since the metallic wall was finely coated with resin no contamination of the nipple portion took place. Furthermore, the appearance and the feel were as good as those of plastic tubes. However, air was not drawn into the tube, which is a major shortcoming of plastic tubes. This prevention of drawing in air is attributed to the improved recovery characteristics of the composite tube constructed and arranged in accordance with the invention. Thus, a composite collapsible tube in accordance with the invention and having these improved properties was obtained.

It will thus be seen that the objects set forth above, among those made apparent from the preceding description, are efficiently attained and, since certain changes may be made in carrying out the above process and in the articles set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A method of manufacturing a side seamless collapsible composite tube comprising:

forming a tube blank having a tubular nipple section, a shoulder section joined to said nipple section and a tubular barrel section joined to said shoulder section from a metallic blank material, said sections forming a continuous tube wall;

reducing the thickness of said tubular barrel section wall of said tube blank to a thickness of from about 20 to 70μ, by drawing said tubular barrel section through at least one die ring having a slip-in angle of from about 1° to 4°, a horizontal ironing distance of from about 0.01 to 0.75 mm and a hardness of from about HRC 60 to 80 and the wall thickness reduction ratio of said barrel section being from about 10 to 30%; and applying a coating of a synthetic resin onto at least a portion of at least one surface of said tubular barrel section wall in a layer from about 50 to 500μ.

2. The method of claim 1, wherein said tube blank is formed by pressing said metallic blank material between a punch and die to form a closed cylindrical body, and said tubular nipple section is formed by deforming the closed end of said closed cylindrical body with a cutter.

3. The method as claimed in claim 1, wherein said tube blank is formed from said metallic blank material by impact extruding said metallic blank material with a punch and die cutter.

4. The method of claim 1, wherein said synthetic resinous layer is applied to said tubular body wall by applying electrostatically charged resin powders to said tubular body wall, and heating to cause fusion welding of said synthetic resinous layer to said wall.

5. The method of claim 1, wherein said synthetic resin is a material selected from the group consisting of vinyl chloride resins, saturated polyester resins, polyamide resins, polyethylene resins, polypropylene resins, epoxy resins and unsaturated polyester resins.

6. The method of claim 1, wherein said synthetic resinous layer is applied to the outer surface of said tubular body wall.

7. The method of claim 1, wherein said synthetic resinous layer is applied to the inner surface of said tubular body wall.

8. The method of claim 1, wherein said synthetic resinous layer is applied to the inner and outer surfaces of said tubular body wall.

9. The method of claim 1, including heating said resin coated tube to melt and weld said synthetic resin to said metallic wall.

10. The method of claim 9, wherein said heating is carried out at a temperature of about 200° C. for at least about 5 minutes.

11. The method of claim 10, including the step of annealing said tube blank after reducing the wall thickness thereof.

12. The method of claim 11, wherein said annealing is carried out at about 500° C. for at least about 5 minutes.

* * * * *